343-872
SR
5/14/85 XR 4,517,571

United States Patent [19]
Mulliner et al.

[11] Patent Number: 4,517,571
[45] Date of Patent: May 14, 1985

[54] LIGHTWEIGHT SLOT ARRAY ANTENNA STRUCTURE

[75] Inventors: Richard R. Mulliner, Fullerton; Richard D. Rocke, La Habra, both of Calif.

[73] Assignee: Hughes Aircraft Company, El Segundo, Calif.

[21] Appl. No.: 275,555

[22] Filed: Jun. 19, 1981

[51] Int. Cl.[3] ..... H01Q 1/42
[52] U.S. Cl. ..... 343/771; 343/872
[58] Field of Search ..... 343/771, 872, 873

[56] References Cited

U.S. PATENT DOCUMENTS

| | | | |
|---|---|---|---|
| 3,453,620 | 7/1969 | Fleming et al. | 343/18 |
| 3,518,688 | 6/1970 | Stayboldt et al. | 343/771 |
| 4,229,745 | 10/1980 | Kruger | 343/771 |
| 4,255,752 | 3/1981 | Noble et al. | 343/771 |

FOREIGN PATENT DOCUMENTS 815576 7/1959 United Kingdom .
1025403 4/1966 United Kingdom .

OTHER PUBLICATIONS

J. W. Small, *Development of a Fiber-Reinforced Composite Design Concept for Large, Mechanically-Scanning, Planar Slot Arrays*, The Record of the IEEE 1977 Mechanical Engineering in Radar Symposium, Nov. 8-10, 1977, New York, pp. 204-209.

*Primary Examiner*—Eli Lieberman
*Attorney, Agent, or Firm*—Thomas A. Runk; A. W. Karambelas

[57] ABSTRACT

A lightweight slot array antenna comprises an array of slotted waveguides and a radome. The radome consists of two or more sheets of fiberglass with a honeycombed dielectric disposed between and bonded to each pair of adjacent sheets. The array of slotted waveguides is disposed inside the radome. Honeycombed dielectric material may be disposed between and bonded to each pair of adjacent waveguides.

20 Claims, 3 Drawing Figures

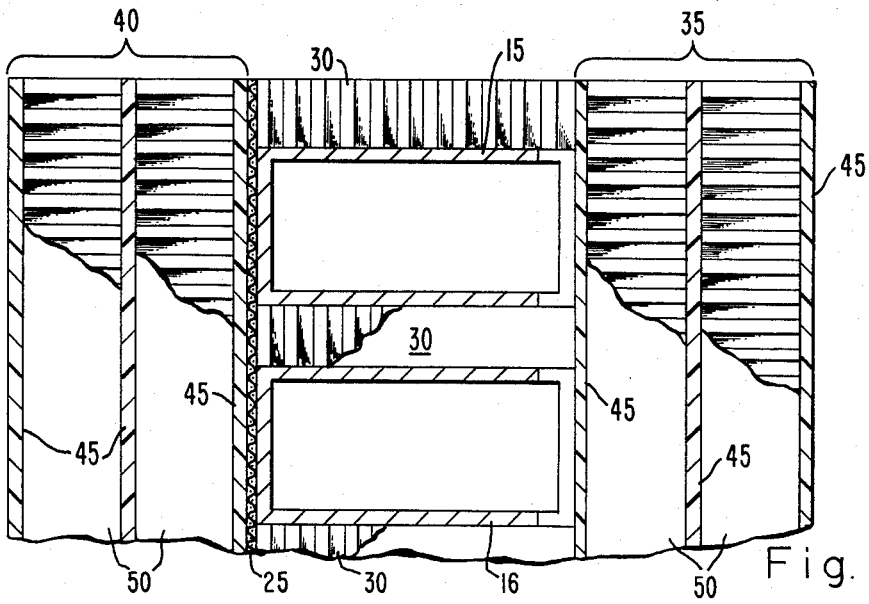
Fig. 2.
Fig. 3.
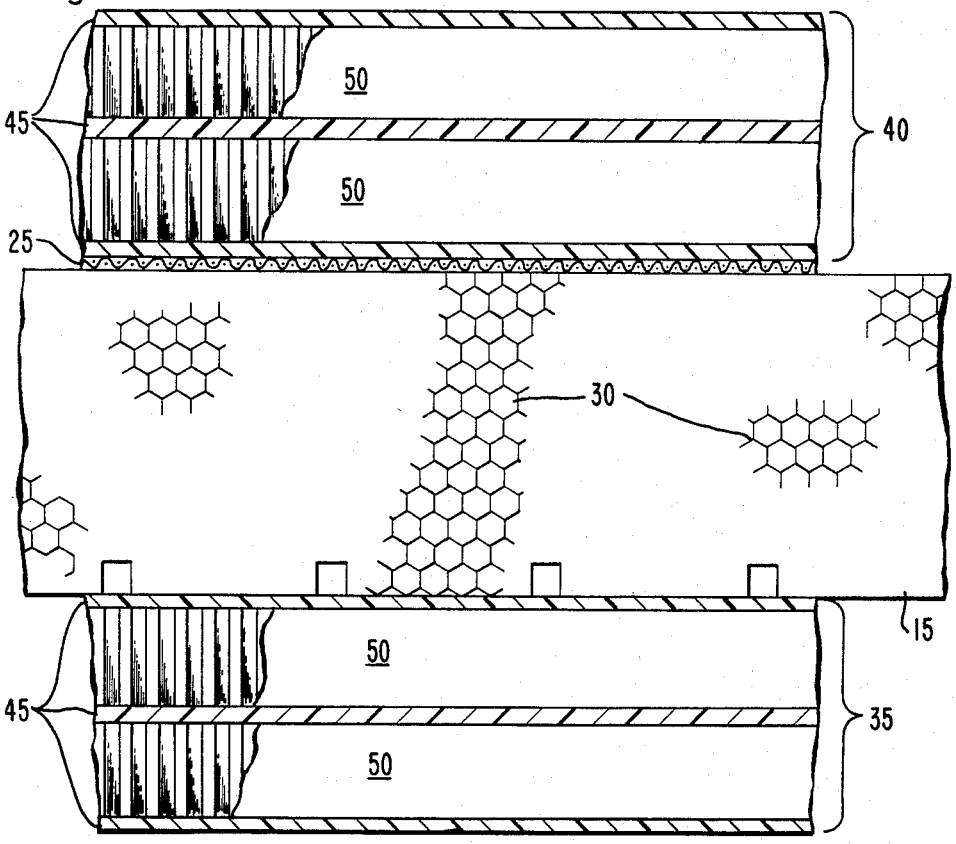

LIGHTWEIGHT SLOT ARRAY ANTENNA STRUCTURE

BACKGROUND OF THE INVENTION

1. Field of the Invention

This invention relates to the field of slot array antennas and more particularly to lightweight armored antennas having high structural strength for use in battlefield environments.

2. Description of the Prior Art

Slot array antennas have been used for radar applications for many years. The slot array antennas generally comprise multiple parallel rows of waveguides having slots in the waveguide walls that face the direction of radiation, structural supports for the waveguides, a radome to weatherize the antenna, and a pedestal to support and rotate the antenna assembly. The antenna assembly generally has a small depth, but a relatively large surface area.

The use of antennas of this type on seagoing vessels presents unique problems. The antenna usually must be situated high on a mast where it is highly exposed to enemy fire and explosive detonations (nuclear and conventional) from all aspect angles. Weight is a highly critical factor, especially since weight above the waterline must be ballasted with greater weights below the waterline to maintain ship stability. Every pound of the antenna must usually be ballasted with about ten pounds below deck. Armoring the antenna and strengthening the structure of the broad, thin antenna panel to allow it to survive flak and the blast effects of explosives adds much weight which will slow the ship. Present antenna designs generally utilize a riveted monocoque structure supporting the array of slotted waveguides and their sinuous feed with ribs, intercostals, a polyester fiberglass radome, and various supplementary pieces. A backbone casting is located behind the monocoque antenna structure, providing the structural interface between the antenna and the pedestal. Conditioning the antenna against the thermal pulse of a nuclear explosion requires the addition of heat resistant dielectric material.

It would be desirable to find a way to reduce the weight of the antenna without increasing its susceptibility to damage from blast and thermal pulses, and it is the solution to this problem to which the present invention is directed.

SUMMARY OF THE INVENTION

It is a purpose of this invention to provide a new and improved lightweight slot array antenna.

It is a further purpose of this invention to totally utilize the structural characteristics of all antenna components to provide an antenna having an optimum strength-to-weight ratio.

It is also a purpose of this invention to provide a lightweight slot array antenna having a design that simplifies the manufacturing process and minimizes manufacturing costs.

A further purpose of this invention is to provide a method for making a lightweight slot array antenna.

To accomplish these purposes while overcoming most, if not all, of the disadvantages of the prior art described above, the present invention provides a lightweight radome for enclosing and structurally supporting an array of slotted waveguides. The radome consists of two or more sheets of an appropriate dielectric material with a honeycombed dielectric material disposed between and bonded to each pair of adjacent dielectric sheets. The array of slotted waveguides is disposed inside the radome. Honeycombed dielectric material may be disposed between and bonded to each pair of adjacent waveguides.

In a preferred embodiment, the axes of the cells of the honeycombed material disposed between the waveguides should be in the plane of the waveguide array and perpendicular to the axes of the waveguides. The axes of the cells of the honeycombed material disposed between the dielectric sheets of the radome should be perpendicular to the planes of the dielectric sheets.

BRIEF DESCRIPTION OF THE DRAWINGS

FIG. 2 is a cross-sectional end view of the antenna module of FIG. 1.

FIG. 3 is a cross-sectional top view of the antenna module of FIG. 1.

DETAILED DESCRIPTION OF THE INVENTION

Figure 1:
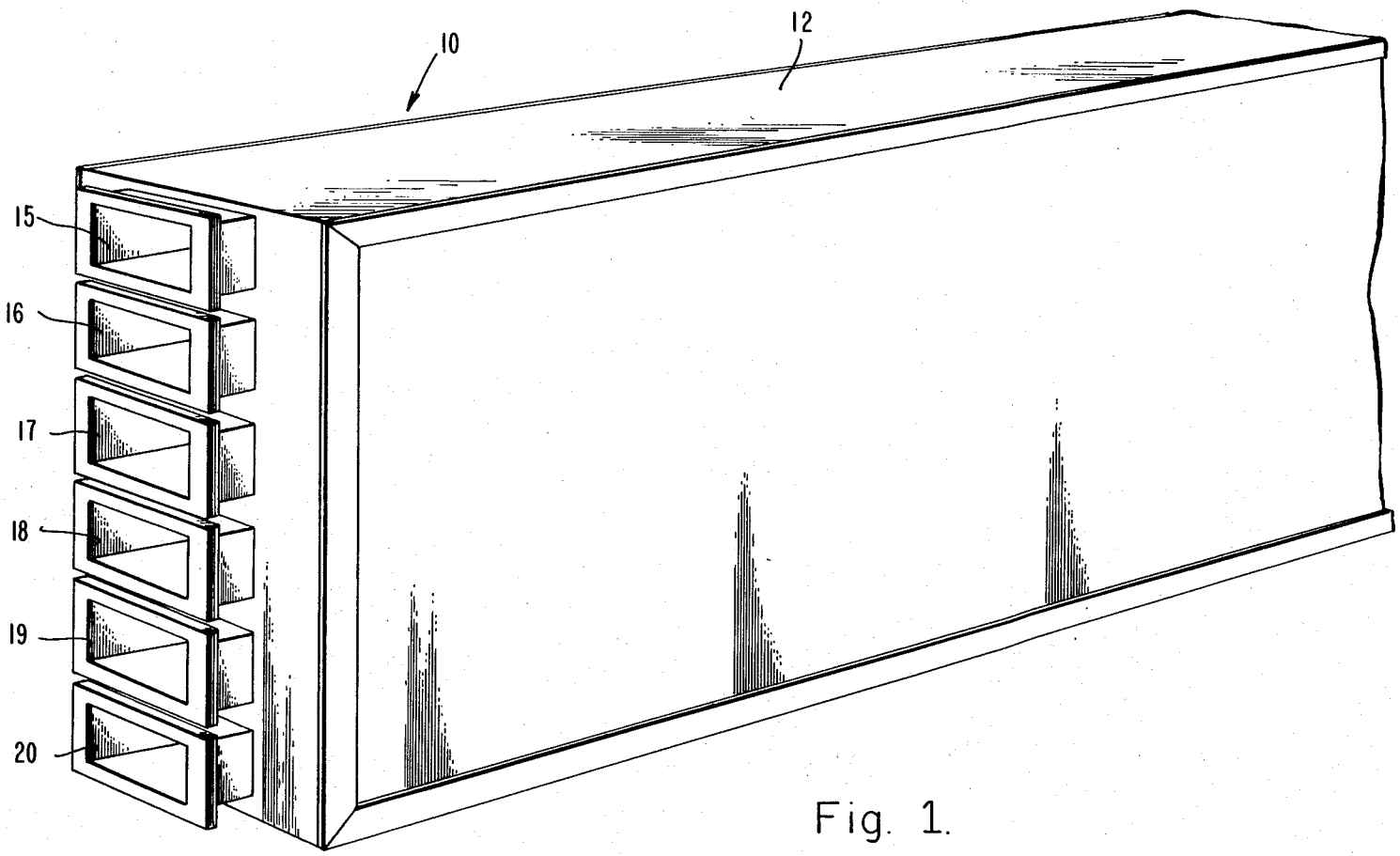
FIG. 1 is a perspective view of a portion of a lightweight integrated slot array antenna module according to one embodiment of the present invention.

A segment of a six-waveguide array module 10 is shown in FIG. 1. A support structure 12 encases six waveguides 15, 16, 17, 18, 19, and 20. These aluminum waveguides can be chemically milled to 0.03 inch wall thickness. Each waveguide extends entirely through the support structure 12 and has a suitable flange at one end for connection to the feed network (not shown). The construction of the support structure is shown in FIGS. 2 and 3. A ground plane 25 lies adjacent to the rear narrow walls of the waveguides 15 and 16. The ground plane 25 can be a fine monel screen. A honeycomb core material 30 is bonded to the broad walls of the waveguides to prevent the thin waveguide walls from buckling under compressive forces.

The waveguides are enclosed by a front radome 35 disposed over the slotted narrow walls of the waveguides and a rear radome 40 disposed over the ground plane 25. Each radome 35 and 40 may comprise three parallel sheets 45 of dielectric material with a layer of honeycomb core 50 bonded between each pair of dielectric sheets 45. The thickness of the front radome 35 should be about one-half of the wavelength of the radiant energy transmitted from the slot array.

The dielectric sheets 45 in each radome 35 and 40 may be made of fiberglass. The outer dielectric sheet 45 of each radome 35 and 40 can be a polyimide-fiberglass to better enable the radomes to withstand the thermal pulses of a nuclear explosion. The other dielectric sheets can be made of epoxy-fiberglass, which is less expensive. The fiberglass can also utilize unidirectional glass, which is glass that has more fibers oriented parallel to the axes of the waveguides than oriented perpendicular thereto. A 65%/35% blend (65% of the fibers oriented parallel to the waveguides axes) has been found to be optimum. The use of unidirectional glass for the dielectric sheets 45 increases the modulus of elasticity in the desired direction to better enable the antenna to withstand explosive blasts.

The honeycomb cores 30 and 50 may be made of glass-reinforced phenolic, which can be purchased from Hexcel, Inc. of Dublin, Calif. For the honeycomb core 50 of the radomes 35 and 40, it is desirable that the ribbon direction of the core be parallel to the axes of the waveguides. This means that some of the bonds between individual cells of the honeycomb will be oriented parallel to the waveguide axes, but none will be perpendicular thereto. This orientation of the honeycomb will give the radomes 35 and 40 greater strength.

As shown in FIGS. 2 and 3, it is desirable for the honeycomb core 30 disposed between the waveguides to be oriented so that the axes of the honeycomb cells are in the plane of the array of waveguides and perpendicular to the axes of the waveguides. It is also desirable that the honeycomb core 50 disposed between the dielectric sheets 45 should be oriented so that the axes of the honeycomb cells are perpendicular to the plane of the dielectric sheets 45.

The antenna module 10 may be constructed by arranging the various waveguides in the desired array and inserting a honeycomb core 30 between each pair of waveguides. Strips of dry film structural adhesive should be located between the honeycomb core and the waveguide walls as required and then activated by heat. The front and rear radomes 35 and 40 are laid up a layer at a time, with dry film structural adhesive located between the dielectric sheets 45 and the honeycomb core 50 as required and then activated by heat. Finally, each radome 35 and 40 is positioned against the array of waveguides, with an adhesive film located as required to form a tight seal.

Although a six-waveguide slot array antenna module has been described, an antenna module can be constructed to employ as many waveguides as desired. Likewise, other construction details can be varied. The radome sandwich structure may have one or as many layers of honeycombed core sandwiched between dielectric sheets as is desirable for a particular application. It may also be desirable to pre-impregnate the sheets with dry adhesive, so that the components may simply be positioned and heated during manufacture. Numerous and varied other arrangements can be easily devised in accordance with the principles of this invention by those skilled in the art without departing from the spirit and scope of the invention.

What is claimed is:

1. A lightweight slot array antenna comprising:

(a) an array of waveguides for radiating or receiving electromagnetic energy comprising:
  (i) at least two slotted waveguides, and
  (ii) honeycomb disposed between and supporting adjacent waveguides, the honeycomb having a surface area substantially equal to the surface area of the waveguide wall which it supports; and (b) a radome means, bonded to the array of waveguides, for enclosing and structurally supporting the array of waveguides, the radome means comprising:
  (i) at least six dielectric sheets, and
  (ii) honeycombed dielectric material disposed between adjacent dielectric sheets.

2. The antenna of claim 1 wherein the ribbon direction of the honeycomb material disposed between the waveguides is parallel to the longitudinal axes of the waveguides.

3. The antenna of claim 2 wherein the longitudinal axes of the cells of the honeycombed dielectric material are perpendicular to the dielectric sheets between which the cells are disposed.

4. The antenna of claim 3 wherein the overall electrical thickness of the radome means disposed in the path of electromagnetic energy radiated by or received by the array of waveguides is substantially one-half wavelength.

5. The antenna of claim 3 wherein the dielectric sheets are disposed substantially parallel to the plane of the array of waveguides.

6. A lightweight slot array antenna comprising:

(a) a front radome disposed in the path of electromagnetic energy radiated by or received by the antenna comprising:
  (i) at least three dielectric sheets, and
  (ii) honeycombed dielectric material disposed between adjacent dielectric sheets;

(b) a rear radome comprising:
  (i) at least three dielectric sheets, and
  (ii) honeycombed dielectric material disposed between adjacent dielectric sheets;

(c) a waveguide array, the array disposed between the front and rear radomes and comprising:
  (i) at least two slotted waveguides, and
  (ii) honeycomb disposed between and supporting adjacent waveguides, the honeycomb having a surface area substantially equal to the surface area of the waveguide wall which it supports.

7. The antenna of claim 6 wherein the ribbon direction of the honeycomb disposed between adjacent waveguides is parallel to the longitudinal axes of the waveguides.

8. The antenna of claim 7 wherein the longitudinal axes of the cells of the honeycombed dielectric material are prependicular to the dielectric sheets between which the cells are disposed.

9. The antenna of claim 8 further comprising a ground plane interposed between the waveguides and the rear radome.

10. The antenna of claim 8 wherein the dielectric sheets of the front and rear radomes are made of fiberglass.

11. The antenna of claim 10 wherein at least one of the dielectric sheets is made of polyimide fiberglass.

12. The antenna of claim 10 wherein the fiberglass dielectric sheets are unidirectional fiberglass.

13. The antenna of claim 8 wherein the honeycombed dielectric material are made of glass-reinforced phenolic.

14. The antenna of claim 8 wherein the overall electrical thickness of the front radome is substantially one-half wavelength.

15. The antenna of claim 8 wherein the dielectric sheets are disposed substantially parallel to the plane of the waveguide array.

16. A sloted waveguide array antenna having an array of slotted waveguides disposed within a dielectric radome, the improvement comprising:

(a) the radome comprising a front radome and a rear radome both of which are connected to the array of slotted waveguides but are disposed on opposite sides of the array, both front and rear radomes comprising at least three dielectric sheets each with honeycombed dielectric material disposed between the sheets; and (b) honeycomb disposed between and supporting adjacent waveguides, the honeycomb having a surface area substantially equal to the surface area of the waveguide wall which it supports, whereby the waveguides are fully supported.

17. The antenna of claim 16 wherein the ribbon direction of the honeycomb disposed between the waveguides is parallel to the longitudinal axes of the waveguides.

18. The antenna of claim 17 wherein the longitudinal axes of the cells of the honeycombed dielectric material are perpendicular to the dielectric sheets between which the cells are disposed.

19. The antenna of claim 18 wherein the front radome is disposed in the path of electromagnetic energy radiated by or received by the antenna and the overall electrical thickness of the front radome is substantially one-half wavelength.

20. The antenna of claim 19 wherein the dielectric sheets are substantially parallel to one another and are parallel to the slotted side of the waveguides.

* * * * *